US005183301A

United States Patent [19]

Lundberg, Jr.

[11] Patent Number: 5,183,301

[45] Date of Patent: Feb. 2, 1993

[54] LOCKING OR SECURITY SEAL

[75] Inventor: George A. Lundberg, Jr., Bloomingdale, N.J.

[73] Assignee: E. J. Brooks Co., Newark, N.J.

[21] Appl. No.: 785,037

[22] Filed: Oct. 30, 1991

[51] Int. Cl.[5] ..... B65D 33/34

[52] U.S. Cl. ..... 292/318

[58] Field of Search ..... 292/318, 319, 321, 322; 24/16 PB

[56] References Cited

U.S. PATENT DOCUMENTS

| | | | |
|---|---|---|---|
| 3,278,214 | 10/1966 | Moberg | 292/318 |
| 4,191,334 | 3/1980 | Bulanda et al. | 24/16 PB |
| 4,272,900 | 6/1981 | MacLarty et al. | 24/16 PB X |
| 4,506,415 | 3/1985 | Swift | 292/318 X |
| 4,537,432 | 8/1985 | Meeks | 292/322 X |
| 4,573,242 | 3/1986 | Lankton et al. | 24/16 PB |

*Primary Examiner*—Richard E. Moore
*Attorney, Agent, or Firm*—John D. Kaufmann

[57] ABSTRACT

A security seal has an elongated flexible strap integral with a housing at one end. The other end of the strap can be moved through a passageway in the housing to form the strap into a closed loop. Facilities in the housing and on one surface of the strap permit movement of the strap out of the passageway and prevent reverse movement of the strap if the strap is properly inserted without a half-twist and into the proper end of the passageway. These facilities are ineffective to prevent reverse movement if the strap is improperly inserted. The seal is improved by forming a groove longitudinally in the passageway. A surface feature on the other surface of the strap is conformally received in the groove when the strap is properly inserted into the passageway without twisting. If the strap is improperly inserted, the passageway interferes with and applies force to the surface feature. This force discolors or deforms the surface feature to provide a visual indication of improper insertion.

9 Claims, 2 Drawing Sheets

LOCKING OR SECURITY SEAL

BACKGROUND OF THE INVENTION

The present invention relates to a locking or security seal, and, more particularly, to a one-piece, molded plastic, disposable locking or security seal adapted to be formed into a loop to close a bag, or to seal some other item such as a trailer, and to give a visual indication of an attempt to gain unauthorized access to the contents of the bag or the sealed item.

One type of security seal for bags and other containers, such as trailers, comprises an elongated flexible band having a free end and a housing at the other end. The band is insertable into a passageway through the housing to form the band into a closer loop. The closed loop may be placed around the neck of a bag or through a hasp or other locking facility. Facilities in the passageway and on the band permit the band to be inserted into the passageway but prevent its withdrawal. Thus, the seal may be rendered ineffective only by rendering it disintegral. If the seal is appropriately constructed, i.e., from plastic attempts to defeat it will be evidenced by deformation or discoloration of the plastic. Accordingly, visual evidence of an attempt to tamper with the seal is given by its disintegrity and by its deformation or discoloration.

Because of the length of the band, it is possible to improperly insert it into the passageway so that the facilities in the passageway and on the band are inoperative or are otherwise unable to prevent withdrawal of the band.

An object of the present invention is the provision of a visual indication that the band has been improperly inserted into the passageway.

SUMMARY OF THE INVENTION

With the above and other objects in view, the present invention contemplates an improved, one-piece seal. The seal has an elongated strap or band with a housing at one end. The free end of the strap is receivable in and movable through a passageway in the housing to configure the strap into a closed loop. Facilities in the passageway and on one surface of the strap prevent withdrawal of the strap from the passageway if the strap does not have a half-twist and is inserted into a selected end of the passageway. The facilities are unable to prevent withdrawal of the strap if it is inserted into the selected end with a half-twist or if it is inserted into the other end of the passageway.

The invention comprises a groove in the passageway and one or more surface features on the other surface of the strap. If the strap is properly inserted into the passageway, the surface feature is conformally received by the groove. If the strap is improperly inserted, a non-grooved portion of the passageway applies force thereto which deforms or discolors the surface feature to provide a visual indication of improper insertion. Preferably, the seal is molded from plastic and the surface fture constitutes one or more raised mesas.

DETAILED DESCRIPTION

Figure 1:
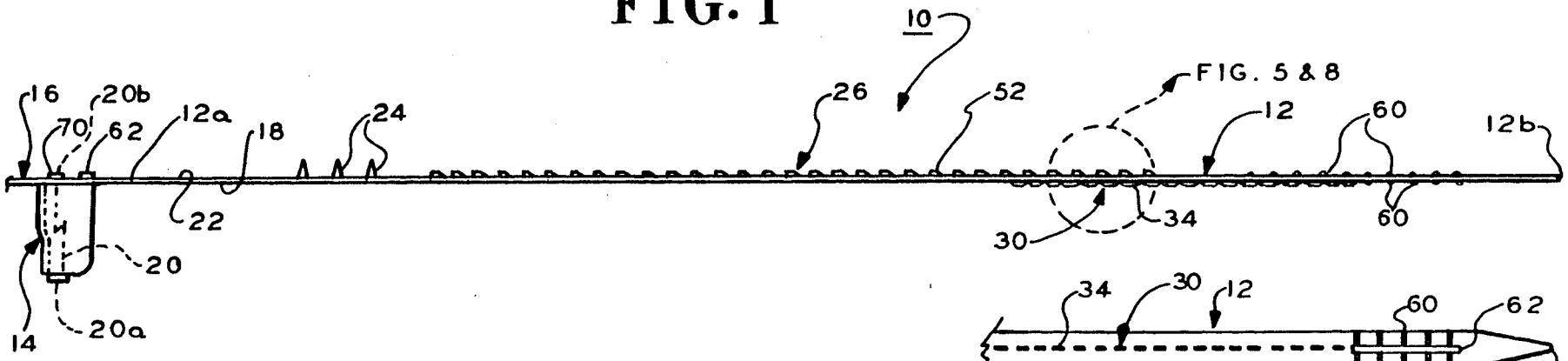
FIG. 1 is a side elevation of a seal according to the present invention, the seal having a band, a housing and a tag.

Referring to FIG. 1, there is shown a locking or security seal 10 according to the present invention. The seal 10 is preferably molded from a suitable plastic, such as nylon or polypropylene as a one-piece, integral unit. The seal 10 includes an elongated, flexible band or strap 12 integral at one end **12*a* with a lock housing 14. The housing may also be integral with a tag 16, which may be generally coplanar with the band or strap 12. Preferably the majority of the housing 14 extends away from one side or surface 18 of the band and of the tag 16. The housing 14 includes a passageway, which is shown schematically at 20 in FIG. 1 (See FIGS. 2–4 for greater detail) and which is described below. The other side or surface 22 of the band or strap 12 carries integral pointed projections 24. One end 20*b* of the passageway 20 is generally coplanar with the side or surface 22 while the other end 20*a* is separated from the surface 18**.

In use, where the seal 10 closes, and is to be pulled tightly about, the neck of a cloth or plastic bag (not shown) which holds items or material (such as money or mail) the free end **12*b* of the band or strap 12 may be inserted through holes or slits in the bag and may then be inserted into the end 20*b* of the passageway 20 in the housing 14 from the side 22. The band 12 is then moved through the passageway 20 until the free end 12*b* exits the end 20*a* of the passageway 20. This forms the band 12 into a closed loop or noose which surrounds the neck of the bag. The band 12 is further moved out of the passageway end 20*a* until the closed loop or noose firmly engages and closes the bag neck. The projections 24 dig into or engage the bag to prevent the seal 10** from being pulled therefrom.

Facilities 26 and 28 located respectively on the band 12 and in the passageway 20 permit the above-described insertion and movement of the end **12*b* of the band 12 through the passageway 20. These same facilities 26 and 28 prevent reverse movement or withdrawal of the band 12 out of the passageway 20. Thus, since the seal 10** cannot be removed without being cut, it cannot be reused or resealed.

Once the seal 10 has closed the bag neck, access to the bag cannot be gained without removing or rendering disintegral (as by cutting) the seal 10. The later two events are, when they occur without authorization, visually detectable, yielding an indication that unauthorized access has been attempted or achieved. Tampering with the seal 10, whether such leads to access or not, typically results in deformation of or "discoloration" of the seal 10 in some area thereof. The "discoloration" usually takes the form of a whitening, clouding or crazing of the plastic of the seal 10 in the area where prying, squeezing, bending or twisting of the seal 10 has occurred. Thus, deformation and discoloration of the seal 10 also yield a visual indication that unauthorized access has been attempted.

The seal 10 can be used on various types of bags, such as money bags, mail bags, courier bags and inner drum bags. The seal 10 may also be used on liquor cabinets, in-room bars in hotel rooms, tote bins and other containers such as trailers, air cargo containers and railroad cars.

As described below regarding the facilities 26, 28, given the length of the band 12—typically, from 7 inches to about 16 inches—it is possible to incorrectly insert the free end 12*b* of the band 12 into the passageway 20. First, the free end 12*b* may be inserted into the end 20*b* of the passageway 20 after the band 12 is given a half-twist. Second, the free end 12*b* may be inserted into the end 20*a* (instead of the end 20*b*) of the passageway 20 with the band 12 untwisted. In either case the facilities 26, 28 become inoperative to prevent withdrawal of the band 12 from the passageway 20. As a result, the seal 10 could be disassembled, without a visual indication thereof being given, and, following unauthorized access to the bag, the seal 10 could be reassembled in the proper fashion.

The present invention comprises facilities 30 on the band 12 and facilities 32 in the passageway 20 for providing the user of the seal 10 with a visual indication, at the time the seal 10 is emplaced on a bag, that one of the above improper installations has been employed.

Figure 3:
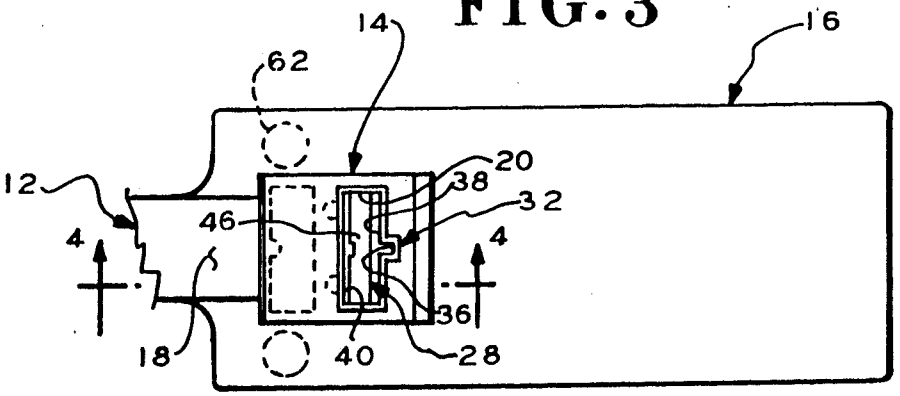
FIG. 3 is a bottom view of a portion of the seal of FIG. 1 showing the interior of the housing.
Figure 2:
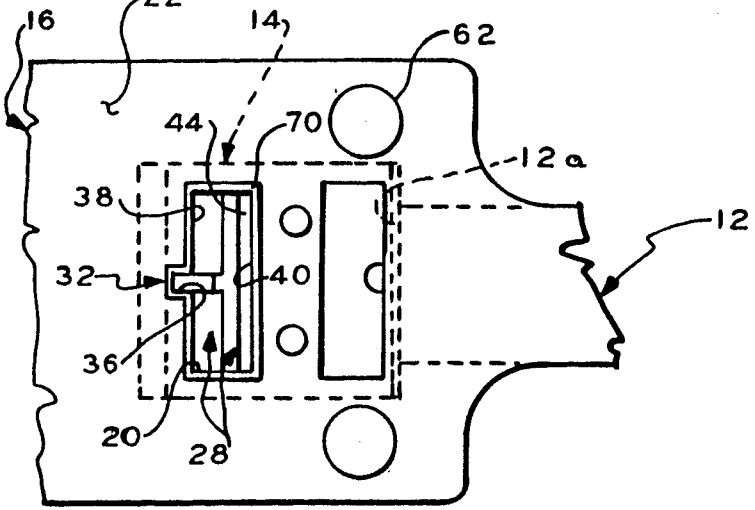
FIG. 2 is a top view of a portion of the seal of FIG. 1 showing the interior of the housing and the tag.
Figure 5:
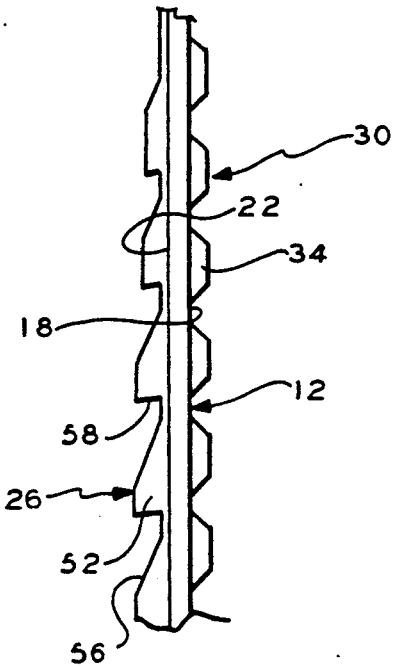
FIG. 5 is an enlarged side view of a portion of the strap of FIG. 1.
Figure 8:
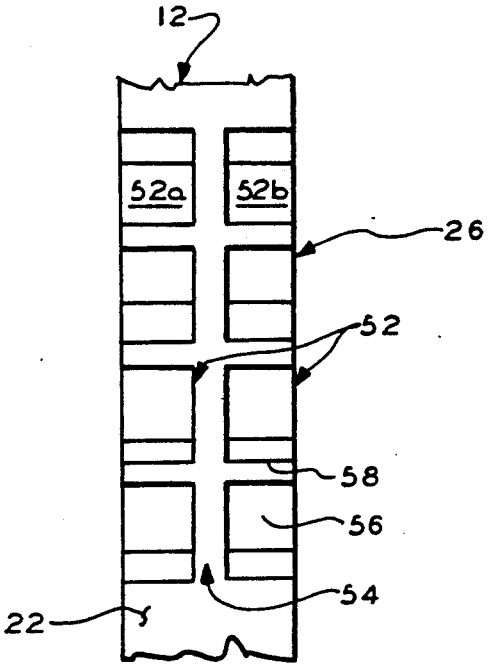
FIG. 8 is an enlarged top view of the portion of the strap shown in FIG. 5.

The band 12 has a generally rectangular cross-section and the passageway 20 has a similar, conformal cross-section (See FIGS. 2 and 3). The facilities 26 on the band 12 reside on the surface or side 22. The facilities 30 on the band 12 are on the surface or side 18. That is, as shown in FIGS. 1 and 5, the facilities 26 and 30 are preferably on opposite sides 18, 22 of the band 12.

The facilities 30 comprise a plurality of small mesas or projections 34 integral with the surface 18 of the band 12. The facilities 32 comprise a groove or channel 36 formed in a wall 38 of the passageway 20 for conformally receiving the mesas 34. The groove 36 is oriented so that when the free end 12*b* of the band 12 is properly inserted into the end 20*b* of the passageway 20, the band 12 is conformally received with clearance by the passageway 20 and the mesas 34 are conformally received with clearance in the groove 36 (See FIGS. 4 and 5). Movement of the band 12 through the passageway 20 results in no deformation or discoloration of the mesas 34.

However, if one of the two improper insertion methods are attempted, the mesas 34 are located diametrically away from and do not enter, the groove 36. Instead, as the band 12 moves conformally through the passageway 20, the mesas 34 are forced past and through a wall 40 of the passageway 20 opposite the wall 38. The wall 40 has no groove. The forces applied to the mesas 34 by the wall 40 deform or discolor them, thus providing a visual indication that the seal 10 has been improperly assembled. Moreover, the interference between the mesas 34 and the wall 40 requires that high pulling force be applied to the end 12*b* of the band 12. This high force can provide a tactile indication that the band 12 is being improperly inserted into the passageway 20.

As should be apparent, the facilities 30 and 32, that is, the mesas 34 and the groove 36 of the present invention, are usable with a wide variety of facilities 26 and 28 for preventing removal of the band 12 from the housing. Specific preferred facilities 26, 28 are described hereafter, it being understood that the facilities 26, 28 may assume other forms than those described herein.

Figure 4:
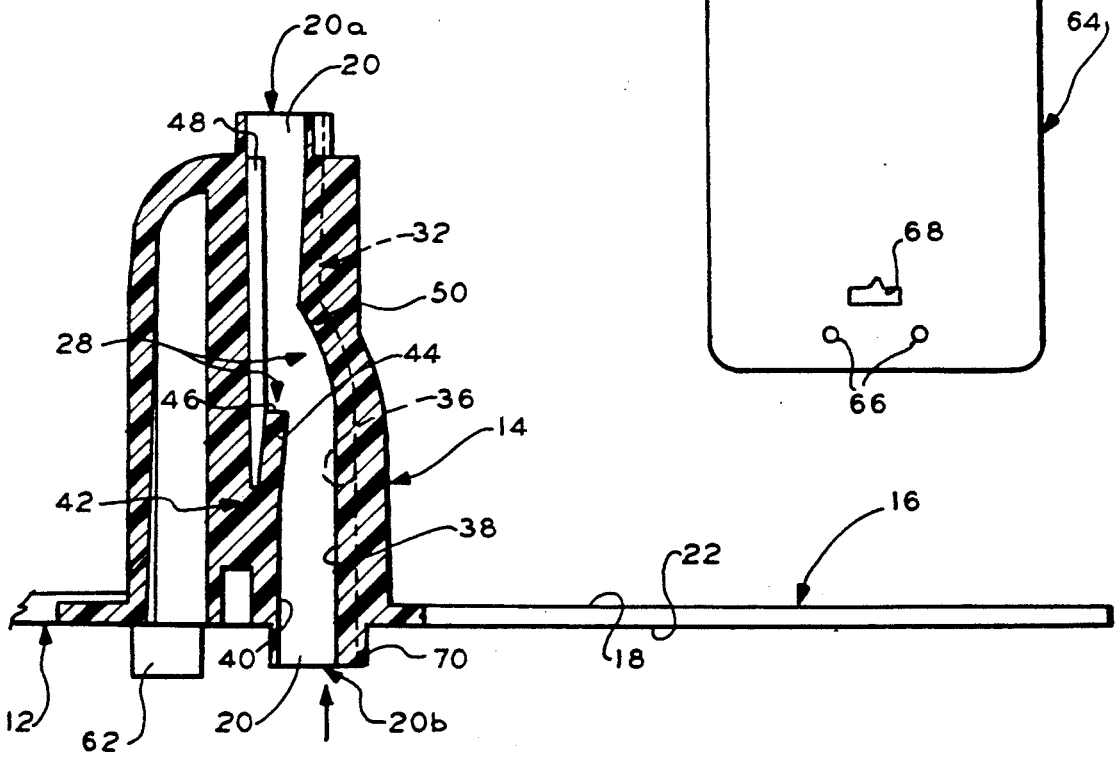
FIG. 4 is an enlarged sectional side view of the seal housing taken along line 4—4 in FIG. 3.
Figure 7:
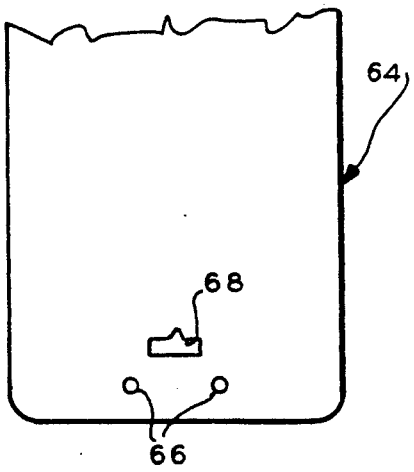
FIG. 7 is a top view of an indicia bearing flag usable with the seal of FIG. 1.

One form of the facilities 28 is first described. The walls 38 and 40 of the passageway 20 have somewhat complex configurations. Referring to FIG. 4, starting at the end 20*b* of the passageway 20, the wall 40 extends toward the end 20*a* and is "stepped," that is, is dislocated to the left in FIG. 4, as generally shown at 42, thence continuing to the end 20*a*. In the vicinity of the step 42 there extends across the width of the passageway 40 a flexible, pawl-like member 44. The member 44 has a latch surface 46. A rib 48 is formed on the wall 40 and extends from near the end 20*a* to underneath the member 44 with which it is integral.

The wall 38 extends from the end 20*b* toward the end 20*a*, slightly narrowing the passageway 20 by turning toward the wall 40, as generally shown at 50, and then terminating at the end 20*a*. The groove 36 follows the contour and track of, and is formed in the wall 38.

In one form, the facilities 26 comprise a series of ratchet-like locking lugs or teeth 52 on the surface 22 of the band 12. A groove 54 (FIG. 5) may be centrally located along the band 12 to divide each of what would otherwise be one lug 52 into a pair of side-by-side lugs 52*a* and 52*b*.

When the end 12*b* of the band 12 is properly inserted into the end 20*b* of the passageway 20 and the end 12*b* is further pulled after it exits the end 20*a* of the passageway 20, the lugs 52 travel past the member 44. The step 42 and the turn 50 force the band 12 to follow a slightly sinuous path with the rib 48 riding in the groove 54 between the side-by-side lugs 52*a*, 52*b* and the mesas 34 freely moving through the groove 36. Camming surfaces 56 on the lugs 52 flex the member 44 away therefrom as the band 12 moves through the passageway 20. As the lugs 52 move, latch surfaces 58 thereon move past the latch surface 46 permitting the member 44 to move toward the band 12. An attempt to reversely withdraw the band 12 from the end 20*b* of the passageway causes the latch surface 58 of the lug 52, which is now adjacent the member 44, to be engaged by the latch surface 46 of the member 44. Such engagement prevents reverse movement or withdrawal of the band 12 from the passageway 20. The sinuousness of the band 12 as imposed on it by the sinuous passageway ensures that the surfaces 46 and 58 cannot disengage while an attempt at withdrawal occurs.

The groove 54 and the rib 48 may be eliminated. However, it has been found that their presence renders "picking" of the seal 10 more difficult. Specifically, with the groove 54 and rib 48 present, disengaging the surfaces 46 and 58 by manipulation of a tool or shim inserted into the passageway 20 from the end 20*a* proves quite difficult, since both sides of the member 44 on either side of the rib 48 must be flexed and disengaged from what are, in effect, two lugs 52*a* and 52*b*.

Figure 6:
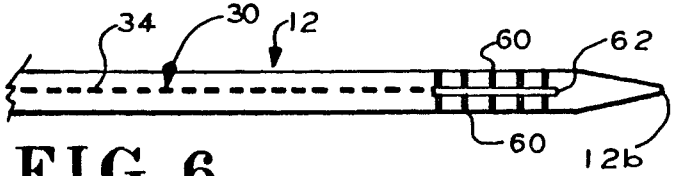
FIG. 6 is a bottom view of a portion of the strap of FIG. 1.

To aid in pulling the band 12 through the passageway 20, there may be formed near the free end 12*b* on one or both surfaces 18, 22 a plurality of grip lugs 60 (FIGS. 1 and 6). The grip lugs 60 aid the manually gripping and pulling of the end 12*b* out of and away from the end 20*a* of the passageway 20. A slit 62 may be formed through the band 12 near the end 12*b*. The slit 62 may be engaged by a hook-like tool (not shown) to enable the band 12 to be firmly and tightly wrapped about the bag. Another tool (not shown), or one integral with the hook-like tool, may contain a transverse blind slot, the walls of which are shaped to engage and conform to the lugs 52. This enables the slot to conformally receive a section of the band or strap 12. The received band 12 may be further tightened (pulled through the passageway 20) and, if the slot engages the band or strap 12 near the end 20*a* of the passageway 20, to be twisted about the long axis of the band to snap off or break the excess portion of the band 20 extending beyond the housing 14 at the end 20*a*.

The tag 16 may include one or more (preferably two) integral projecting studs 62 near the end 20*b* of the passageway 20. The studs 62 are, therefore, located on the side 22 of the tag 16. A flag 64, preferably made of plastic, contains two holes 66 which are complementary to the studs and a hole 68 which is complementary to the end 20*b* of the passageway 20 and can receive therethrough a shroud or cowl 70 which may be shaped like and surround the end 20*b* of the passageway 20. The holes 66 are fitted over and mounted on the studs 62 and the hole 68 is fitted over the shroud 70. The stud-hole 62–68 mounting may be a removable snap fit, or the studs 62 may be deformed by heat or otherwise to permanently mount the flag 64 to the seal 10.

The tag 16 serves as a partial backing support for the flag 64, which may be substantially larger than the tag 16 and may bear various bag-contents-related indicia related to point of origin and/or destination, contents, import/export data and other data, such as inventory control data. The data may be put on the flag 64 by a removable adhesive label (not shown) or by directly writing thereon. When the band or strap 12 is held within the housing 14, it passes through the hole 68 (or through the shroud 70 which is surrounded by the hole 68) to prevent loss of the flag 64 should it inadvertently become disassociated from the studs 62.

Those skilled in the art will appreciate that various changes and modifications may be made to the foregoing without departing from the spirit and scope of the following claims.

I claim:

1. An improved one-piece locking or security seal of the type having an elongated, flat, flexible strap integral with a housing on one end, the other end of the strap being conformally receivable in, and movable through, a passageway in the housing to form the strap into a closed loop; means, located in the passageway and on one surface of the strap, responsive to insertion of the strap without a half-twist therein into a selected end of the passageway for permitting movement of the strap out of the other end of the passageway and for preventing reverse movement of the strap; the permitting and preventing means being ineffective to prevent such reverse movement if the strap is inserted into the selected passageway end with a half-twist therein or is inserted into the other passageway end without twisting; the improvement comprising:

an elongated groove formed in and longitudinally of the passageway, a surface feature on the other surface of the strap which is conformally received in the groove when the strap is inserted into the selected end of the passageway without twisting, the passageway interfering with and applying force to the surface feature if the strap is inserted into the selected passageway end with a half-twist or is inserted into the other passageway end without twisting, force applied to the surface feature discoloring or deforming it to provide a visual indication of improper insertion.

2. A seal as in claim 1, wherein:

the seal is integrally molded from plastic.

3. A seal as in claim 2, wherein:

the surface feature is a raised mesa integral with the other surface of the strap.

4. A seal as in claim 3, wherein:

a plurality of raised mesas are located on the other surface of the strap.

5. A seal as in claim 2, wherein:

the portion of the permitting and preventing means on the one surface of the strap constitutes a plurality of ratchet-like teeth, and the portion of the permitting and preventing means in the passageway constitutes a pawl-like flexible member.

6. An improved security seal of the type having a housing and an integral, elongated band; the housing having a passageway therethrough for generally conformally receiving the band for insertion thereinto from one side of the housing and for movement in a first direction through the housing beyond the other side of the housing; the improvement comprising:

a plurality of ratchet-like teeth on one side of the band;

a pawl-like flexible member in the passageway for permitting the band to move through the passageway in the first direction and for preventing reverse movement of the band, the member permitting the teeth to bypass it during movement in the first direction, the member engaging the teeth to prevent reverse movement;

a series of protrusions on the other side of the band; and a groove formed in the passageway for conformally receiving the protrusions, insertion of the band from the other side of the housing or insertion of the band from the one side of the housing after the band has received a half twist causing the protrusions to engage a non-grooved region of the passageway to thereby effect interference between the protrusions and the passageway, which interference applies force to the protrusions which causes deformation or discoloration of the protrusions to give a visual indication that the seal has been improperly assembled.

7. A seal as in claim 6, which further comprises:

a channel formed in the teeth along the strip to divide each tooth into a side-by-side pair of teeth, and a raised rib in the passageway which is slidably received in the channel as the strap moves in the first direction, the rib and the channel resisting disengagement of the pawl-like member from the teeth by a tool inserted into the passageway by requiring that both teeth of a side-by-side pair on either side of the rib be simultaneously disengaged from the pawl-like member.

8. An improved indicia-carrying member for use with a security seal, the seal being of the type having a strap integral with a housing at one end, the other end of the strap being movable through a passageway in the housing to form the strap into a closed loop; means in the passageway and on the strap for preventing reverse movement of the strap out of the passageway, wherein the improvement comprises;

a tag having an enlarged surface and being integral with the strap and the housing;

a flag having a hole therethrough, the hole being locatable about the point at which the strap enters the passageway, the flag having an enlarged surface; and means for mounting the flag to the tag with the hole and the passageway entry point being aligned.

9. An improved security seal as in claim 1, wherein the improvement further comprises:

an indicia-carrying member, which includes a tag having an enlarged surface which is integral with the strap and the housing;

a flag having a hole therethrough, the hole being locatable about the point of entry of the strap into the passageway, the flag having an enlarged surface; and means for mounting the flag to the tag with the hole and the passageway entry point being aligned.

* * * * *